US009861838B2

(12) United States Patent
Huggins

(10) Patent No.: US 9,861,838 B2
(45) Date of Patent: Jan. 9, 2018

(54) ONE-WAY VALVE

(75) Inventor: Adrian Huggins, Worthing (GB)

(73) Assignee: QINETIQ LIMITED (GB)

( * ) Notice: Subject to any disclaimer, the term of this patent is extended or adjusted under 35 U.S.C. 154(b) by 241 days.

(21) Appl. No.: 13/809,230

(22) PCT Filed: May 18, 2011

(86) PCT No.: PCT/GB2011/000752

§ 371 (c)(1),
(2), (4) Date: Jan. 9, 2013

(87) PCT Pub. No.: WO2012/010815

PCT Pub. Date: Jan. 26, 2012

(65) Prior Publication Data

US 2013/0112205 A1 May 9, 2013

(30) Foreign Application Priority Data

Jul. 21, 2010 (GB) ..... 1012205.9

(51) Int. Cl.

| | |
|---|---|
| ***A62B 9/02*** | (2006.01) |
| ***A62B 18/02*** | (2006.01) |
| ***A62B 18/10*** | (2006.01) |
| ***B63C 11/16*** | (2006.01) |

(52) U.S. Cl.

CPC ..... *A62B 18/10* (2013.01); *B63C 11/16* (2013.01)

(58) Field of Classification Search

CPC ..... A61M 16/208; A61M 16/00; A61M 16/20–16/209; A61M 16/06–16/0694; A61M 16/0003–16/0012; A61M 2016/0015–2016/0042; A62B 7/00; A62B 7/14; A62B 9/00; A62B 9/02–9/027

USPC ..... 128/201.18, 201.28, 203.11, 204.18, 128/204.21, 204.23, 205.23–205.26, 128/206.15, 206.21, 207.12, 207.16

See application file for complete search history.

(56) References Cited

U.S. PATENT DOCUMENTS

| | | | |
|---|---|---|---|
| 4,465,102 | A | 8/1984 | Rupp |
| 6,035,896 | A | 3/2000 | Liardet |
| 2004/0255947 | A1 | 12/2004 | Martin et al. |
| 2009/0133700 | A1 | 5/2009 | Martin et al. |

FOREIGN PATENT DOCUMENTS

| | | | |
|---|---|---|---|
| EP | 0 252 890 | 1/1988 | |
| EP | 1820541 | 8/2007 | |
| EP | 2014325 | 1/2009 | |
| WO | WO 2010052241 A1 * | 5/2014 | ..... A61M 16/00 |

* cited by examiner

*Primary Examiner* — (Jackie) Tan-Uyen T Ho
*Assistant Examiner* — Ned T Heffner
(74) *Attorney, Agent, or Firm* — McDonnell Boehnen Hulbert & Berghoff LLP

(57) ABSTRACT

A one-way valve for use in the inhalation and/or exhalation flowpath of respiratory protection equipment comprises a housing 1 defining a conduit and a circumferential array of three flexible flaps 2 each extending inwards from the conduit wall and in the direction away from the inlet end I of the valve. Under a pressure differential in the opening direction of the valve each flap is adapted to flex outwards towards the conduit wall and under a reverse pressure differential the free edge 5,5 of each flap is adapted to press in sealing contact with respective portions of the free edges of the neighboring flaps.

7 Claims, 6 Drawing Sheets

ONE-WAY VALVE

FIELD OF THE INVENTION

The present invention relates to valves and more particularly to valves for use in respiratory protection equipment (RPE) which expression encompasses military and industrial respirators (both unpowered and powered types), gas masks, dust masks, surgical masks, compressed air and oxygen-fed breathing apparatus (including underwater breathing apparatus) and the like.

BACKGROUND OF THE INVENTION

RPE typically incorporates one-way valves in the inhalation and/or exhalation flowpaths of the equipment to regulate the gas flow to and from the user so that clean respirable gas is inspired and waste gas is expired, without the risk of contamination from the environment or significant rebreathing of exhalate. A common form of one-way valve for this purpose is the so-called mushroom or flapper valve which in one form comprises a circular elastomeric disc fixed to a seat at its centre and is adapted to operate in one of two ways when subject to a pressure differential in the opening direction. That is to say it can either "butterfly" with opposite "wings" of the disc lifting off the seat at its periphery at low flow rates and then at higher flow rates the whole of the disc lifting, or the whole of the disc lifts off the seat around the whole periphery at all flow rates, the amount of lift being a function of the rate of flow. The second case is the more beneficial as it gives even flow around the disc. In practice the disc can be in the form of a smooth dome ("mushroom") or stepped circular "pyramid", the steps helping to regulate the lifting off the seat. In any case the presence of the seat restricts the maximum flow area available through the valve, however, which negatively influences the breathing resistance of the valve, particularly at high flow rates. To compensate for this shortcoming the diameter of such valves must be relatively large, typically 1 inch (25.4 mm). This can be a disadvantage; for example when such valves are installed in the usual positions on a face piece of RPE they can reduce the space available for other elements such as a transparency or communication devices. Furthermore the ability of such valves to prevent reverse flow critically depends on the integrity of the contact of the disc with a rigid knife-edge surface around the periphery of the seat and this can sometimes be a cause of leakage particularly if dust or other particulates are present on the seat or disc.

SUMMARY OF THE INVENTION

The present invention seeks to address the above-mentioned drawbacks of the prior art and in one aspect resides in a one-way valve for use in the inhalation or exhalation flowpath of respiratory protection equipment, comprising a conduit and a circumferential array of at least three flexible flaps each extending inwards of the conduit from the wall thereof and away from the inlet end of the valve in the unflexed condition of the respective flap, whereby under a pressure differential in the opening direction of the valve each said flap is adapted to flex outwards towards the wall of the conduit and under a reverse pressure differential the free edge of each said flap is adapted to press in sealing contact with the respective portions of the free edges of the neighbouring said flaps.

It is currently considered that the optimum number of flaps in a valve according to the invention is three, although embodiments are possible where there are four or even more such flaps.

A valve according to the invention requires no seat for the flaps to seal against to prevent reverse flow through the valve since this function is provided by the sealing contact between the flaps themselves. Furthermore the valve can be configured so that in the fully open condition the flaps are flexed so that substantially the whole of each flap lies close to the wall of the conduit. In this way at high flow rates virtually the whole of the unobstructed bore of the conduit is available for flow. It follows that for similar performance in terms of breathing resistance a valve according to the invention can have a significantly smaller diameter than the conventional mushroom valve, meaning for example that a greater area of transparency can be incorporated in a face piece to which such valves are mounted. By way of example a valve substantially in accordance with the preferred embodiment to be more particularly described and illustrated herein has been successfully constructed and tested with a diameter of 16 mm. In addition the seal effected between mating flexible flaps can be more tolerant of dust or other particulates and less prone to leakage in the reverse direction than the seal between the disc and seat in the conventional mushroom valve.

In a preferred embodiment each flap of the valve is formed with two integral leaves and a central ridge at the junction of the respective said leaves, each said ridge extending at an oblique angle to the wall of the conduit and (when there are three such flaps) the free edges of the respective said leaves extending at an angle of substantially 120° to each other in the unflexed condition of the respective flap. Preferably the ridge of each said flap is substantially straight in the unflexed condition of the respective flap.

Preferably also the free edges of all said flaps lie in a common plane substantially perpendicular to the axis of the conduit in the unflexed condition of the flaps.

In another aspect the invention resides in an item of RPE comprising a valve as defined above in the inhalation and/or exhalation flowpath of the equipment.

DESCRIPTION OF THE DRAWINGS

The invention will now be more particularly described, by way of example, with reference to the accompanying drawings in which.

DESCRIPTION OF THE INVENTION

Figure 1:
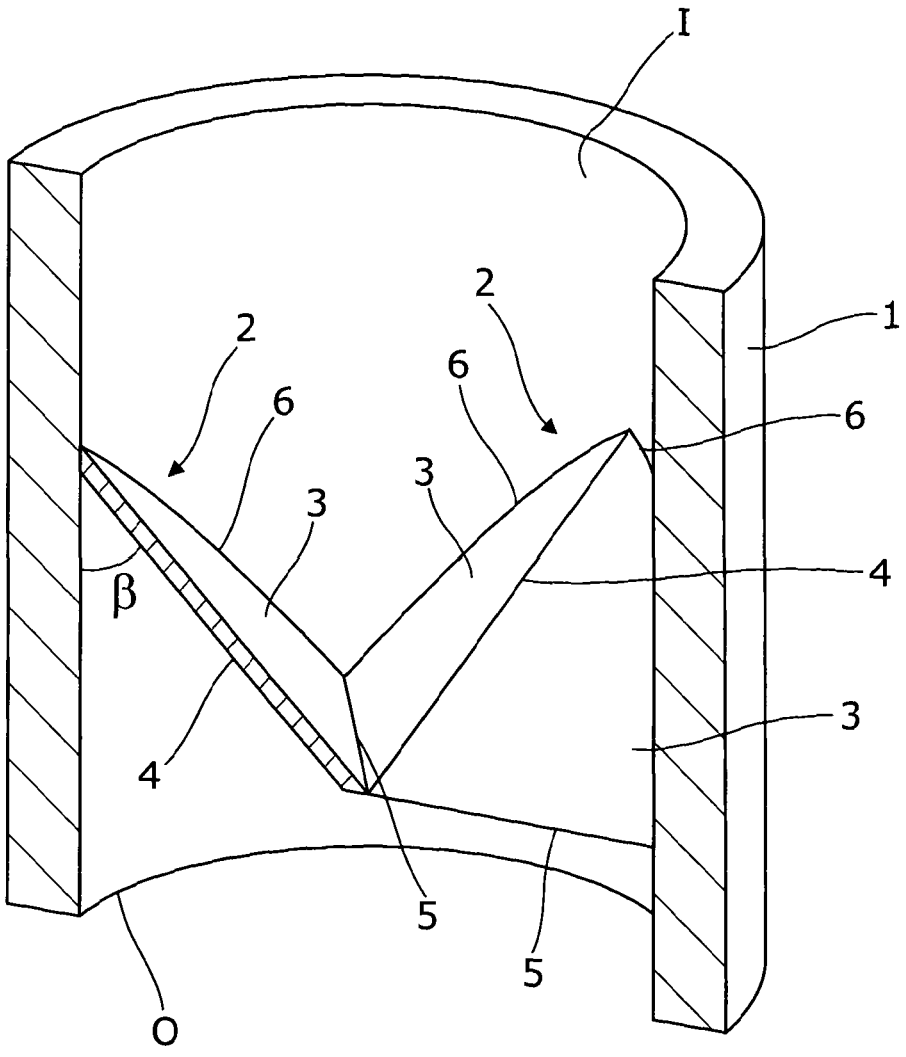
FIG. 1 is an axial section through a preferred embodiment of a valve according to the invention, with its flaps in the unflexed condition.
Figure 2:
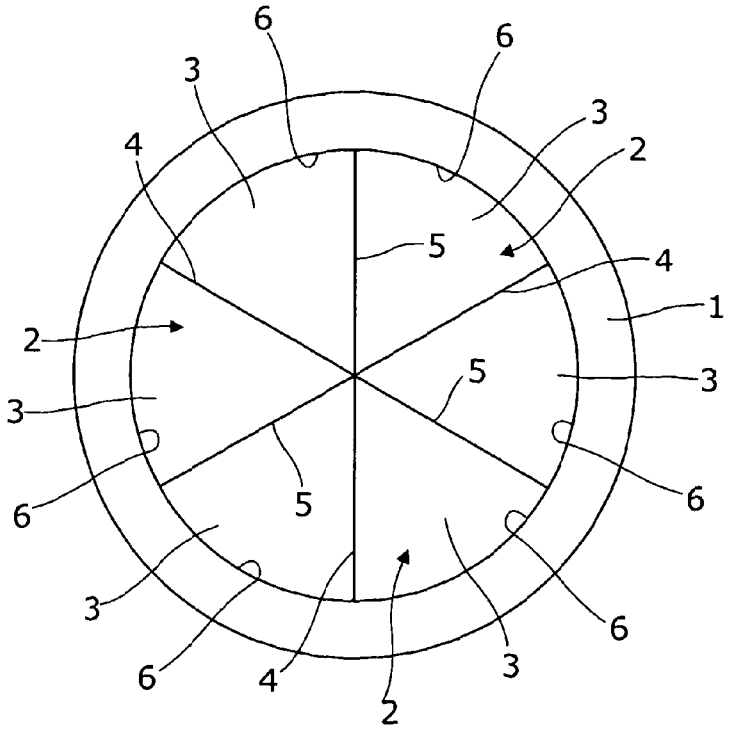
FIGS. 2 and 3 are views of the valve of FIG. 1 respectively from its inlet and outlet ends, with its flaps in the unflexed condition.
Figure 3:
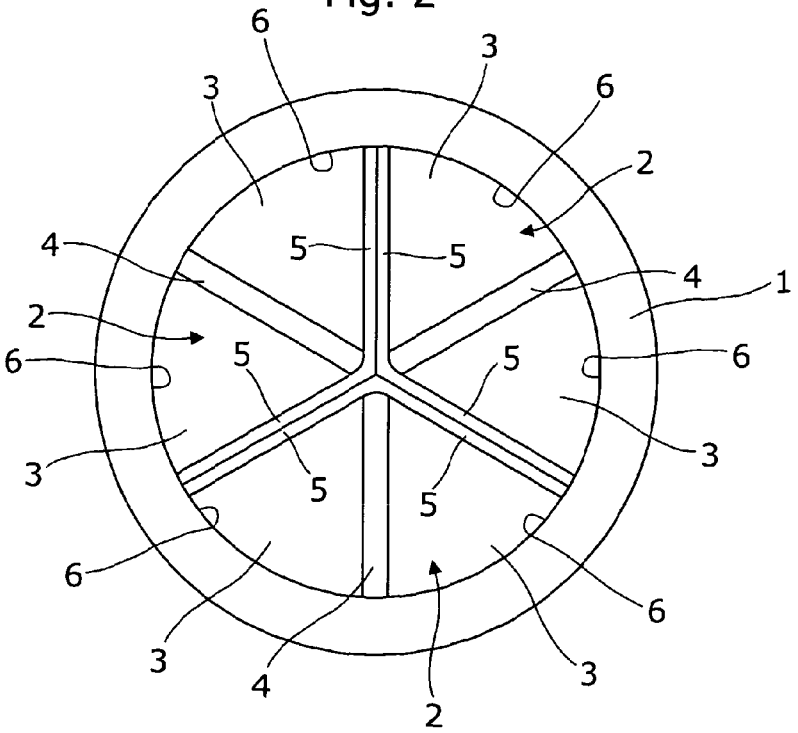
Figure 4:
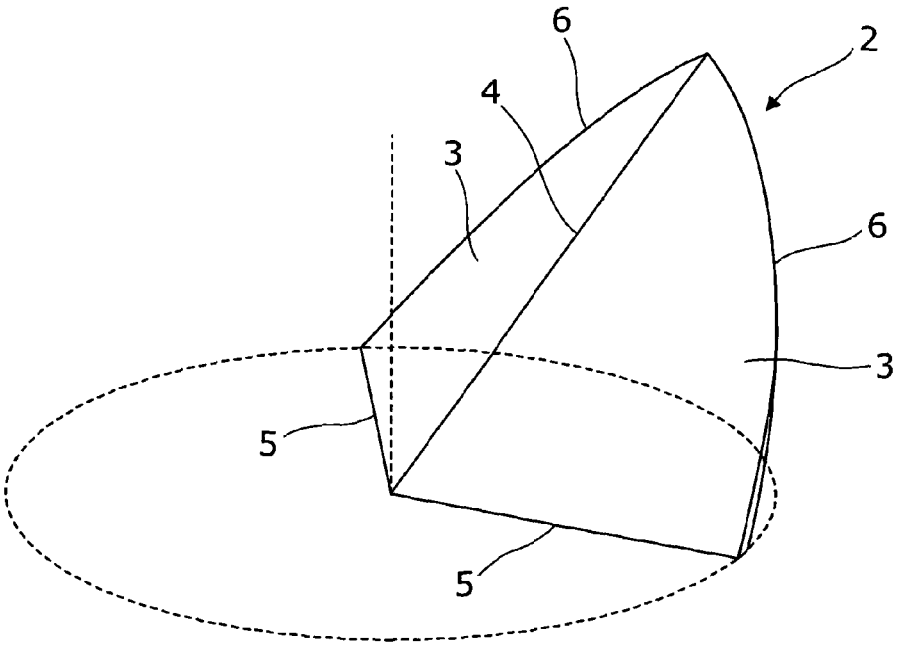
FIGS. 4 and 5 are views respectively from the front and rear of an individual flap of the valve of FIGS. 1 to 3 in its unflexed condition, and with the axis and internal circumference of the associated housing superimposed in broken line.
Figure 5:
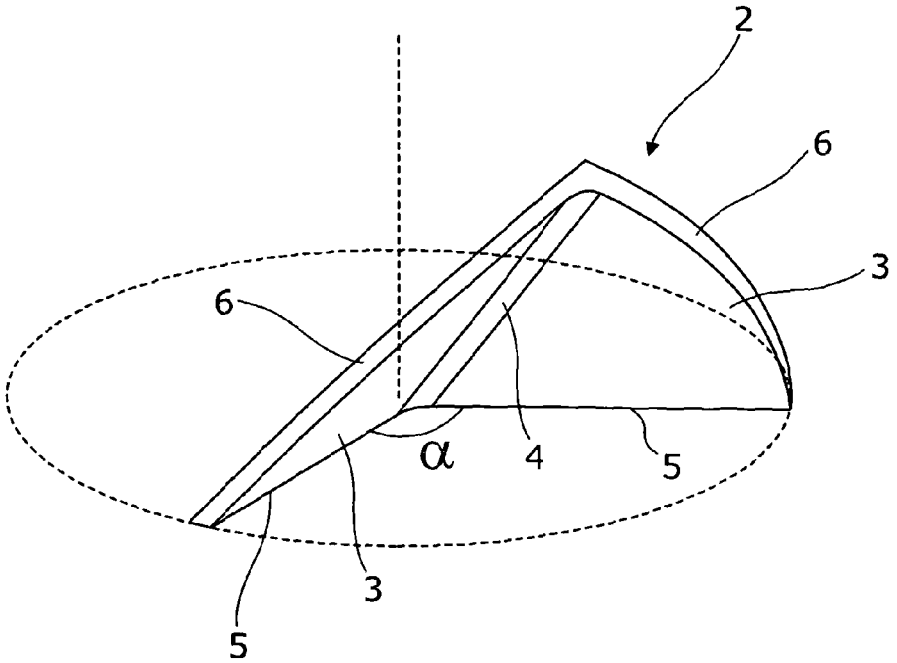

Referring to FIGS. 1 to 5, the illustrated valve is a one-way valve for use in the inhalation or exhalation flowpath of an item of respiratory protection equipment (RPE) and comprises a tubular cylindrical housing 1 which defines a conduit through which, in use, respirable gas passes to or exhalate passes from the wearer of the RPE as the case may be. As viewed in FIG. 1 the inlet I of the valve is at the upper end and the outlet O of the valve is at the lower end of the housing 1, although the valve may be used in any orientation. Within this housing there is a circumferential array of three substantially identical flaps 2, each of the form more particularly shown in FIGS. 4 and 5. That is to say in its unflexed condition each flap 2 comprises an integral pair of substantially flat, generally triangular leaves 3 extending at an angle α of substantially 120° to one another from a substantially straight central ridge 4. To complete the "triangle", each leaf 3 also has a straight edge 5 and an arcuate edge 6.

In the assembled valve each flap 2 is sealingly fixed to the internal wall of the housing 1 along its arcuate edges 6 so that the flap extends inwards of the conduit from the housing wall and away from the inlet end of the valve as more particularly shown in FIG. 1. When so assembled, in the unflexed condition of the flaps the free edges 5 of all flaps lie in a common plane substantially perpendicular to the axis of the housing 1 and each edge 5 of each flap 2 lightly contacts a corresponding edge 5 of the neighbouring flap along its length. Attachment of the flaps to the housing may be achieved e.g. by adhesive bonding along the edges 6, or by co-moulding. Alternatively the flaps 2 could be provided with additional beads along their edges 6 which are trapped in a profiled groove formed between two mating parts which make up the housing 1.

Figure 6:
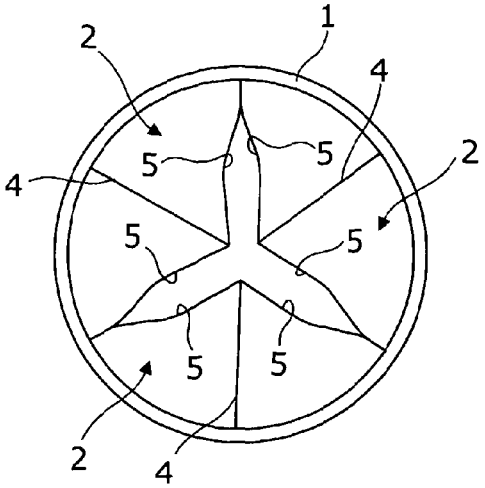
FIGS. 6 to 9 are views similar to FIG. 2 of the valve with its flaps in increasingly flexed conditions corresponding to increasing flow rates through the valve.
Figure 9:
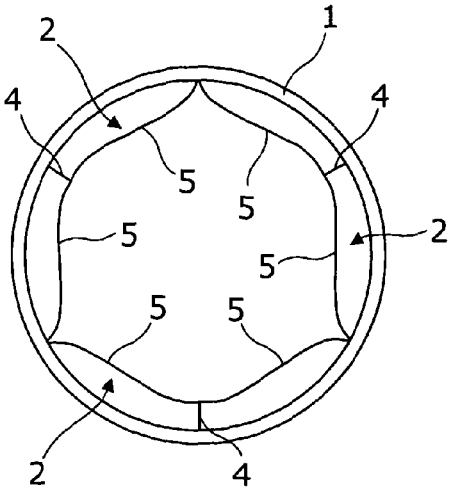
Figure 7:
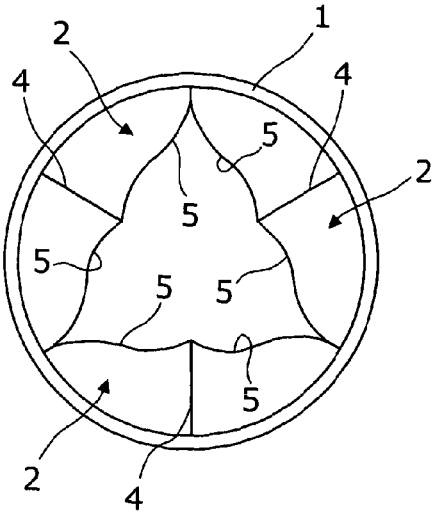
Figure 8:
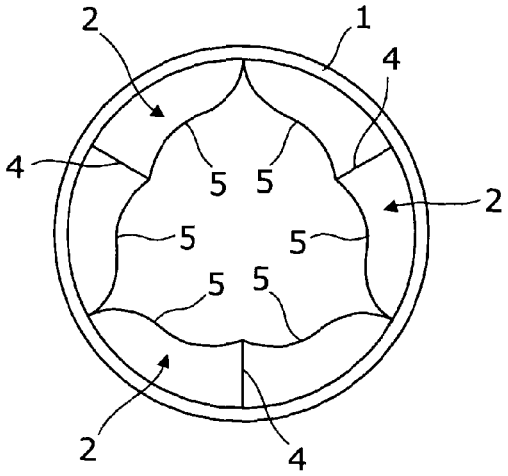

When the valve is subject to a pressure differential in the opening direction—such as by the user applying an inspiratory effort to the outlet end of the valve when used as an inhalation valve or applying an exhalatory effort to the inlet end when used as an exhalation valve—the tendency is for each flap 2 to flex outwards towards the wall of the housing 1, opening a gap between the edges 5 of neighbouring flaps and permitting passage of gas from the inlet to the outlet. The typical forms of flexure with increasing pressure differentials and flow rates through the valve are shown in FIGS. 6-9, the ridge 4 of each flap acting as a stabilising influence. In the limit, as indicated in FIG. 9, the flaps can flex to lie substantially wholly close to the wall of the housing 1, thereby opening up virtually the whole of the unobstructed bore of the housing for flow. It should be noted that FIGS. 6-8 illustrate the ideal situation in which each flap 2 behaves identically to the others in response to a given pressure differential. In practice there may be variations in behaviour between the flaps when the valve is only partially open due for example to tolerances in the manufacture of the flaps themselves or variations in flow conditions across the bore of the housing.

When the valve is subject to a pressure differential in the reverse direction, however—such as due to the pressure increase experienced at the outlet of an inhalation valve during exhalation or the pressure reduction experienced at the inlet of an exhalation valve during inhalation—the tendency of the higher pressure applied to the rear side of each flap 2 is to "inflate" it away from the wall of the housing 3 and thereby press its edges 5 in sealing contact with the corresponding edges 5 of the neighbouring flaps. The higher the pressure differential the tighter the contact will be between the flaps and the contact area between them will also tend to increase the harder they are pressed together, so the better the seal. Reverse flow though the valve is therefore reliably blocked by this contact between the flaps without the need for any additional valve seat.

Figure 10:
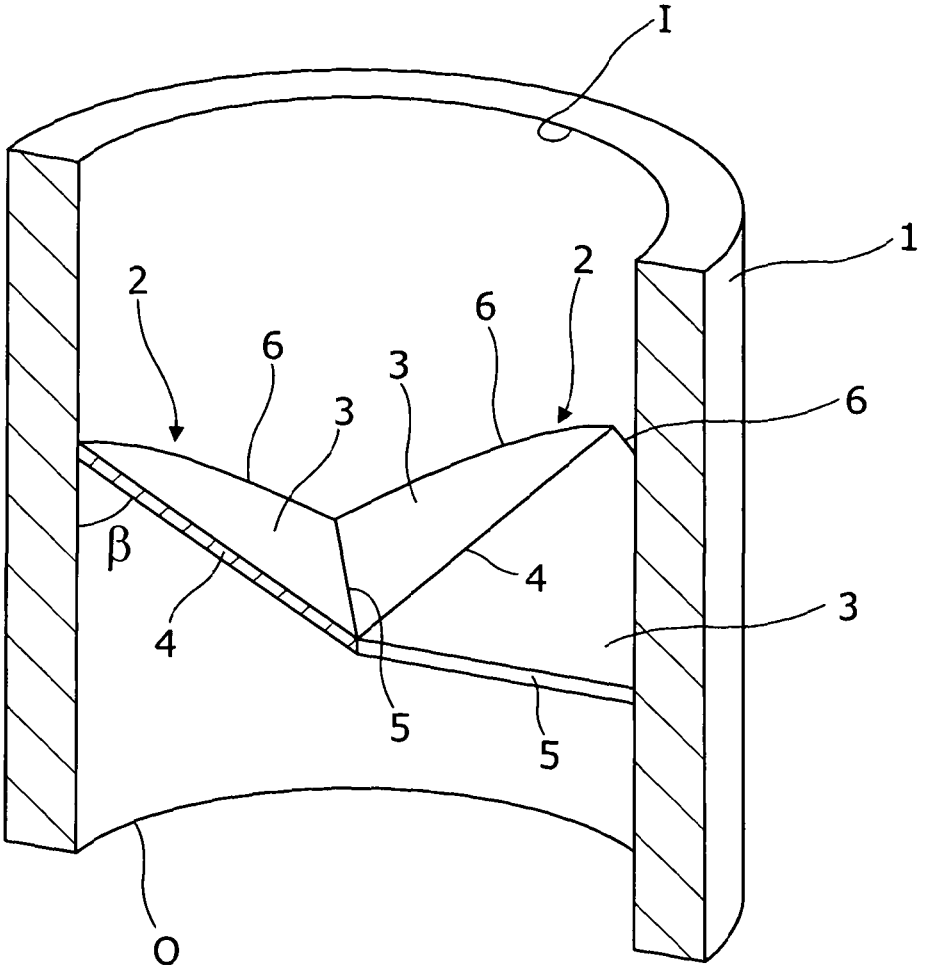
FIG. 10 is a view similar to FIG. 1 of a variant of the valve.

In a valve of this kind there are a number of design variables that can be altered to give varying flow characteristics. Two are the thickness of and material from which the flaps 2 are made, to achieve a desirable balance of flexibility and durability. Various elastomers may be chosen for this purpose, including natural rubber and polyurethane, although the presently preferred material is a plasticized silicone. Another variable is the length of the flaps 2 in the flow direction, or in other words the angle β (FIG. 1) formed between the ridge 4 of each flap and the housing wall. In the FIG. 1 embodiment this is 40° although there may be a range of such angles in other embodiments. For example FIG. 10 illustrates a "shallower" variant of this valve where the angle β is increased to 55° and the flaps 2 do not therefore extend so far along the length of the conduit defined by housing 1. Generally speaking it has been found that "shallower" valves such as the FIG. 10 embodiment provide lower pressure drops across the valve at lower flow rates but higher pressure drops across the valve at higher flow rates as compared to "deeper" valves such as the FIG. 1 embodiment. The "deeper" valves provide a more even pressure drop across the valve for a wide range of flow rates. The angle β can therefore be selected to give the most advantageous pressure drop across the valve for a given flow regime.

The valve illustrated in FIG. 10 also incorporates a design variation in the profile of the edges 5 of the flaps 2, from a sharp edge in FIG. 1 to a thicker edge in FIG. 10, although either profile may be used irrespective of the angle β.

Figure 11:
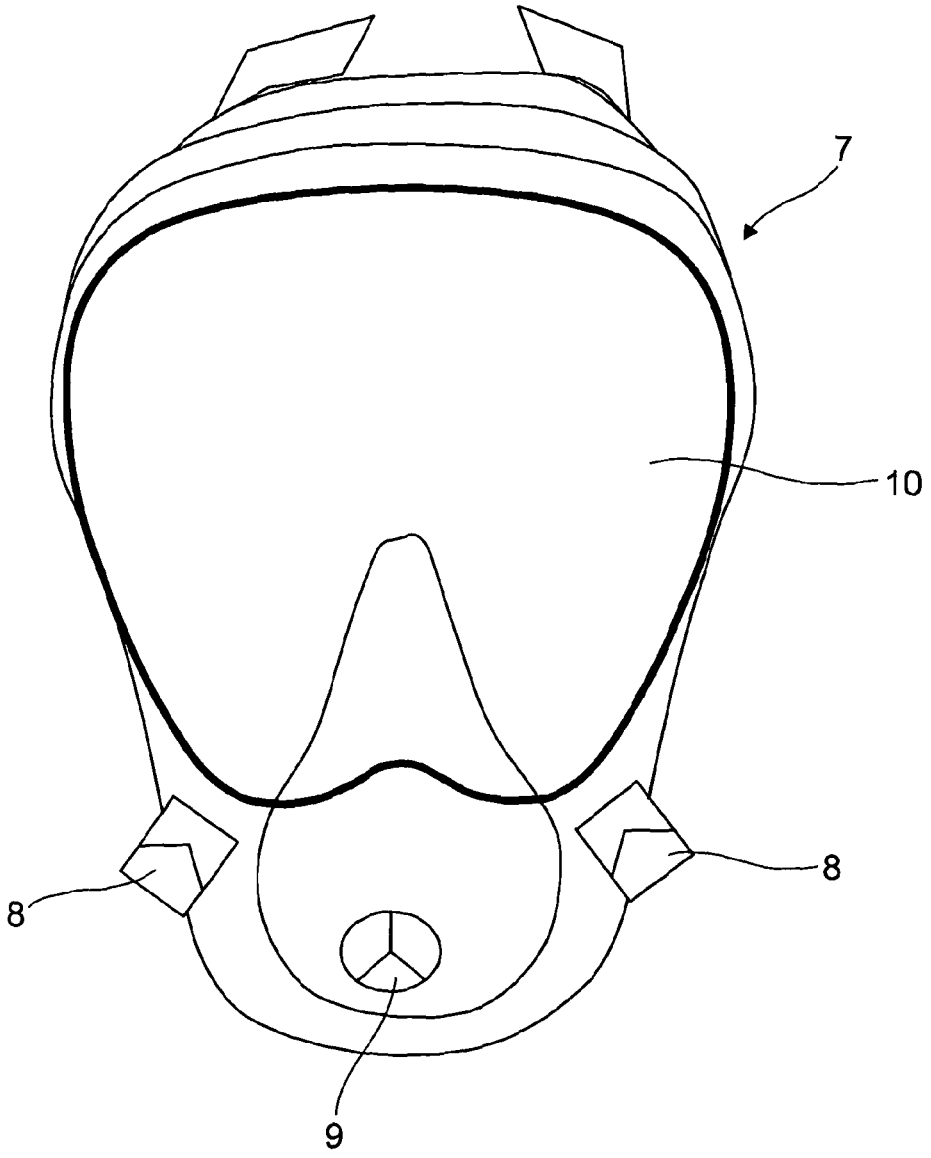
FIG. 11 illustrates the application of valves according to the invention to a respirator facepiece.

As previously indicated, due to the construction and operation of valves according to the invention they can be made to a smaller diameter than conventional mushroom valves for similar performance, typically only 16 mm versus 25.4 mm. FIG. 11 illustrates the application of valves as described above to a typical respirator facepiece 7. Two inhalation valves 8 according to the invention are fitted, one in each lower cheek region of the facepiece, and in this example their inlet ends will be configured with screw threads or otherwise for the connection of filter canisters (not shown). An exhalation valve 9 according to the invention is also fitted centrally in the chin region of the facepiece. Due to the relatively small diameters of the valves 8 and 9 the area of the facepiece over which a transparency 10 can be fitted is increased substantially compared to a facepiece with conventional mushroom valves. This increased area may be of advantage not only in increasing vision for the wearer of the respirator but also in making more of his face visible from the outside, enhancing recognition of and communication with the wearer.

The invention claimed is:

1. A one-way valve for restricting fluid flow in one direction along an inhalation or exhalation flowpath of respiratory protection equipment, said valve comprising a circumferential array of at least three flexible flaps, each flap including an arcuate edge that is fixed directly to an internal wall of a conduit and free edges, wherein in an unflexed condition the flaps extend both inwards of the conduit from the internal wall thereof and also away from an inlet end of the valve, whereby under a pressure differential caused by fluid flow in an opening direction of the valve; each said flap is adapted to flex outwards towards the internal wall of the conduit, and under a reverse pressure differential caused by fluid flow in a closing direction of the valve, each free edge of each said flap which is not fixed to the internal wall of the conduit being are adapted to respectively press in sealing contact with a free edge of a neighbouring said flap in said circumferential array.

2. The valve according to claim 1 wherein the free edges of all said flaps lie in a common plane substantially perpendicular to an axis of the conduit in the unflexed condition of said flaps.

3. The valve according to claim 1 wherein substantially the whole of each said flap is adapted to lie close to the internal wall of the conduit in a fully flexed condition of the respective flap.

4. A respirator comprising the valve according to claim 1 in an inhalation and/or exhalation flowpath.

5. The valve according to claim 1, each said flap having two integral triangular leaves and a central ridge at the junction of the respective said leaves, each said ridge extending at an oblique angle to the internal wall of the conduit.

6. The valve according to claim 5 wherein the free edges of each said flap, which are not fixed to the internal wall of the conduit, extend at an angle of substantially 120° to each other in the unflexed condition.

7. The valve according to claim 5 wherein said ridge of each said flap is substantially straight in the unflexed condition of the respective flap.

* * * * *